US005772403A

United States Patent [19]

Allison et al.

[11] Patent Number: 5,772,403

[45] Date of Patent: Jun. 30, 1998

[54] PROGRAMMABLE PUMP MONITORING AND SHUTDOWN SYSTEM

[75] Inventors: Charles B. Allison; Christopher C. Ginn; I. Michael Ginn; Amos Pacht, all of Houston, Tex.

[73] Assignee: Butterworth Jetting Systems, Inc., Houston, Tex.

[21] Appl. No.: 624,891

[22] Filed: Mar. 27, 1996

[51] Int. Cl.[6] ..... F04B 49/06

[52] U.S. Cl. ..... 417/44.2; 417/44.3

[58] Field of Search ..... 417/12, 44.2, 44.3, 417/53, 63; 60/445; 62/129; 364/558

[56] References Cited

U.S. PATENT DOCUMENTS

| | | | |
|---|---|---|---|
| 3,882,861 | 5/1975 | Kettering et al. | 417/44.2 |
| 4,257,747 | 3/1981 | Goldman . | |
| 4,505,643 | 3/1985 | Millis et al. | 417/12 |
| 4,551,077 | 11/1985 | Pacht . | |
| 4,716,924 | 1/1988 | Pacht . | |
| 4,823,552 | 4/1989 | Ezell et al. | 60/443 |
| 4,833,614 | 5/1989 | Saitoh et al. | 364/424.05 |
| 4,936,747 | 6/1990 | Mitsuhashi et al. . | |
| 4,955,795 | 9/1990 | Griffith | 417/44.3 |
| 4,990,057 | 2/1991 | Rollins . | |
| 5,020,972 | 6/1991 | Nakayama et al. . | |
| 5,046,397 | 9/1991 | Ezell et al. | 91/167 R |
| 5,064,347 | 11/1991 | La Valley, Sr. | 417/44.2 |
| 5,140,311 | 8/1992 | Cook . | |
| 5,145,322 | 9/1992 | Senior, Jr. et al. . | |
| 5,190,442 | 3/1993 | Jorritsma . | |
| 5,302,087 | 4/1994 | Pacht . | |
| 5,317,870 | 6/1994 | Inagawa | 60/418 |
| 5,385,452 | 1/1995 | Lyday . | |
| 5,388,965 | 2/1995 | Fehn . | |
| 5,413,404 | 5/1995 | Inagawa | 340/451 |
| 5,540,555 | 7/1996 | Corso et al. | 417/44.2 |
| 5,601,414 | 2/1997 | DiRe | 417/44.2 |

*Primary Examiner*—Timothy Thorpe
*Assistant Examiner*—Xuan M. Thai
*Attorney, Agent, or Firm*—Browning Bushman

[57] ABSTRACT

A control system 10 for monitoring operation of a high pressure plunger pump 12 includes a microprocessor-based controller 40 and a plurality of sensors. Inlet pressure transducers 48 output electrical signals to the controller at intervals of less than 1 millisecond, indicative of the instantaneous inlet pressure to the pump. The controller 40 shuts down pump operation if a number of instantaneous pressure signals within a selected time period exceeds a predetermined value, or if the average inlet pressure signal exceeds a preselected value. The control system 10 is substantially tamperproof, and stored data indicative of tampering, pump startup, pump shutdown, and pump alarm conditions are recorded in a memory for subsequent retrieval and analysis. The serial interface 82 allows communication between the system operating computer 68 and a setup/processing computer 84, which may optionally be remote from the control system by use of a modem.

22 Claims, 5 Drawing Sheets

FIG. 3
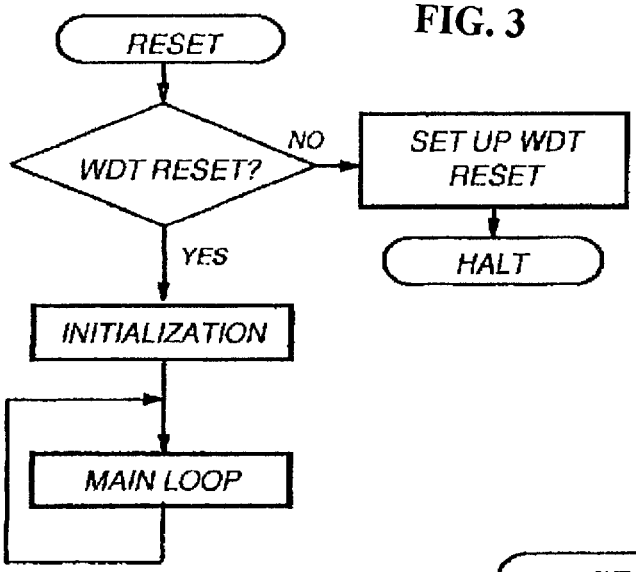
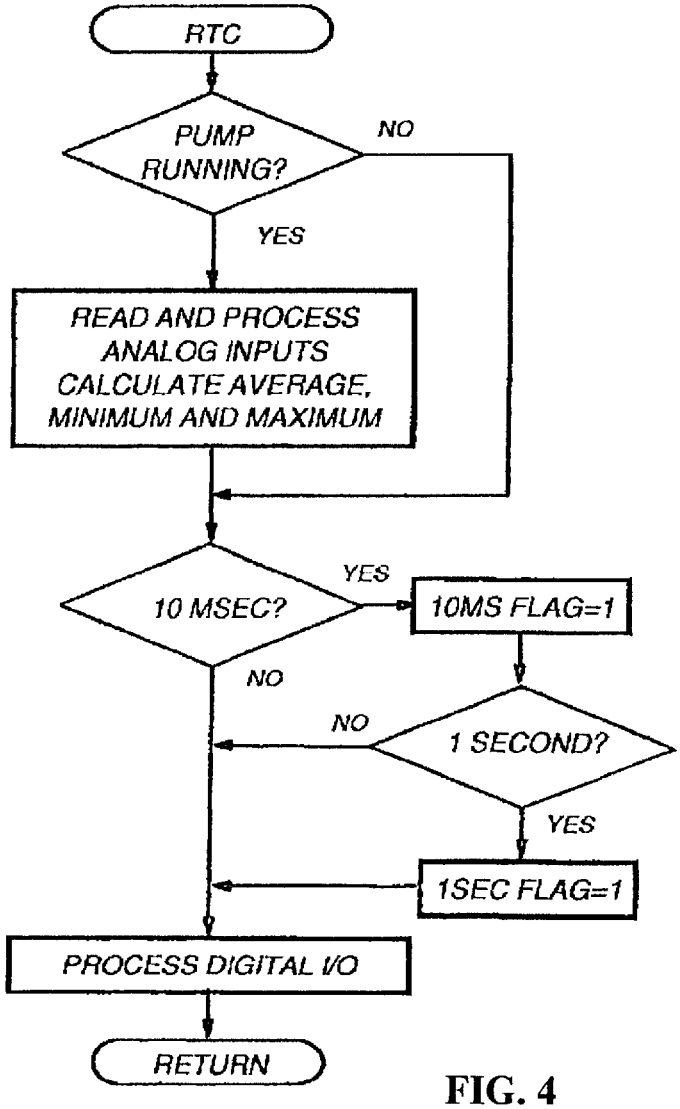
FIG. 4

PROGRAMMABLE PUMP MONITORING AND SHUTDOWN SYSTEM

FIELD OF THE INVENTION

The present invention relates to equipment and techniques for monitoring the operation of a positive displacement pump and for terminating pump operation in response to predetermined conditions. More particularly, this invention relates to a programmable monitoring and shutdown system for a plunger-type pump that is responsive to inlet fluid pressure conditions to prevent damage to the pump due to cavitation.

BACKGROUND OF THE INVENTION

For numerous types of pumps, varying inlet fluid pressure results in little if any damage to the pump. Vane or impeller-type pumps, for example, experience little operational difficulty when fluid pressure to the pump continuously or intermittently drops below a desired value. The impeller pump outputs less fluid, which may be sensed by a downstream flow meter, but the operation of the pump is not adversely effected by the varying inlet fluid pressure conditions. Piston or plunger-type pumps are typically desired over other types of pumps under conditions wherein the pump must be capable of generating high fluid pressure, typically in excess of 1000 psi. In many applications, such as permanent installation pumping operations wherein the plunger pumps are located closely adjacent to a fluid source with a large volume, inlet fluid pressure conditions to the plunger pumps are substantially constant and continually remain within the desired operating range for these pumps. In other applications, however, inlet fluid pressure to a high pressure plunger-type pump can be expected to vary considerably. In these applications, the positive displacement action of the plunger-type pump that generates the high pressure causes significant operational problems if the pump chamber is not completely filled with liquid prior to each pressurizing stroke of the plunger.

One application that significantly benefits from, and practically requires the use of, a plunger-type pump is high pressure liquid spraying and cutting operations. High pressure liquid, which is typically water with an optional abrasive added downstream from the pump, is supplied to a blasting or cutting gun to either clean various types of surfaces or to cut material as the operator discharges the high pressure liquid from the gun. High pressure blasting and cutting operations are frequently portable, and accordingly the pressure of the available liquid supplied to the plunger-type pump may vary considerably.

Those skilled in the art will appreciate that pressure plunger-type pumps have a single plunger or a plurality of plungers each of which are reciprocated by a pump power end that is connected to a suitable motor or engine. Plunger-type pumps suitable for liquid blasting and cutting operations are disclosed in U.S. Pat. Nos. 4,551,077 and 4,716,924. A pressure plunger-type pump with an improved technique for loading compression rods is disclosed in U.S. Pat. No. 5,302,087. U.S. Pat. No. 5,385,452 illustrates the portability of equipment for water blasting and cutting operations, and discloses a hydraulic intensifier with switches to detect the proximity of a piston nearing the end of its power or return stroke to achieve a smoother shift of driving fluid from one intensifier to another intensifier.

Various standards have been adopted that set forth the recommended minimum fluid inlet conditions to feed or supply liquid to high pressure plunger pumps. For various reasons, however, including, for example, poor maintenance of one or more filters in the supply line to the pump or excessively long flexible lines connecting the fluid supply source with the pump, the desired fluid supply conditions to the pump are frequently not maintained. Under these conditions, incomplete filling of a pump chamber resulting in cavitation can significantly damage or cause catastrophic failure of both the pump fluid end and the pump power end. Accordingly, significant costs have long been incurred to repair or replace high pressure plunger pumps used in liquid blasting or cutting operations.

Various systems have been devised to automatically shut equipment down prior to extensive damage. U.S. Pat. No. 4,257,747 discloses a technique for monitoring the vibration frequency of a circular lobe pump and shutting the pump down when a certain vibration spectrum in excess of the compressor operating speed is obtained. U.S. Pat. No. 4,936,747 discloses a technique for monitoring the operation of a compressor and for shutting off the compressor either when the compressor components move outside a predetermined displacement range or when the temperature of the compressor rises above a predetermined value. U.S. Pat. No. 4,990,057 discloses a controller for a compressor that may be responsive to insufficient lubrication pressure, insufficient current to the compressor motor, and self-testing diagnostics for shutting down the compressor when a fault exists for longer than a predetermined time value.

Other prior art systems are specifically intended for monitoring the conditions of a fluid pump. U.S. Pat. No. 5,020,972 discloses a technique for preventing the no-load operation of a pump that supplies liquid from a supply tank to a reservoir tank. A sensor is provided in both the supply tank and the reservoir tank to detect the volume of liquid. When the liquid level in the supply tank falls below a predetermined volume, the control circuit stops the operation of the pump motor. U.S. Pat. No. 5,140,311 discloses a system for shutting down a pump by positioning a metal bar within a preselected distance from a traveling element of the pump, such as a piston rod. An electrical circuit is closed when the metal bar comes into contact with the traveling element, thereby shutting down the pump. The disclosed system can only work in a dry environment, such as carbon dioxide, and would not work on water injection pumps since water would short the electrical circuit. U.S. Pat. No. 5,145,322 discloses a technique for sensing the temperature of pump bearings in a vertical turbine pump, and for shutting the pump down before significant pump damage occurs. U.S. Pat. No. 5,190,422 discloses a programmable pump controller with back pressure sensors to avoid rapid on/off cycling of the pump. U.S. Pat. No. 5,388,965 discloses a monitoring system for a sludge pump. The system detects and reports imminent functional defects or incipient wear by determining the effective amount of sludge conveyed per unit of time and the volumetric fill factor of the pump compared to the theoretical sludge pumping rate.

The monitoring and shutdown systems disclosed in the above patents are not well suited to minimize damage to a plunger-type pump that otherwise would occur when the instantaneous fluid inlet pressure is insufficient to prevent cavitation. Also, prior art monitoring systems are frequently not intended to provide a historical read out of pump operation, which may be invaluable in determining how a pumping system should be modified to minimize future maintenance costs. Many existing systems may also be easily altered or tampered to obviate the monitoring and shutdown system.

The disadvantages of the prior art are overcome by the present invention, and an improved pump monitoring and shutdown system for high pressure plunger-type pumps and a method of monitoring operation of such pumps are hereinafter disclosed. The system and techniques of this invention will significantly contribute to the long life and reduced maintenance costs for plunger pumps. The present invention is particularly well suited for monitoring the operation of a plunger-type pump used in portable water blasting and cutting operations.

SUMMARY OF THE INVENTION

A programmable system monitors pump operation, and particularly instantaneous pump inlet pressure, of a high pressure plunger-type pump. The system repeatedly receives signals indicative of pump inlet pressure, and automatically terminates pump operation when the average pump inlet pressure drops below a preselected value, or when the instantaneous pump inlet pressure exceeds a predetermined range indicative of a cavitation condition. The system automatically records pump operating conditions, and provides a retrievable operating history. The microprocessor-based system may be easily customized for particular applications, and is both weatherproof and tamperproof. Additional sensors may monitor and record pump outlet or discharge pressure, vibration of the pump housing, inlet fluid temperature, pump rpm, and the temperature, pressure and level of oil in pump power end.

The inlet fluid pressure sensor may output an instantaneous pump inlet pressure signal at a predetermined time, e.g., each 100 microseconds. A deadband range of an acceptable instantaneous pump inlet pressure that will not result in cavitation is determined for a particular plunger-type pump. Provided the instantaneous fluid inlet pressure varies within the predetermined acceptable deadband range and the average pump inlet pressure exceeds the preselected average minimum value, the controller will allow continued pump operation. Within a selected test period of, for example, 10 milliseconds, if the instantaneous pump inlet pressure signals exceeds the deadband range above a selected number of times, an alarm may be activated, the pump shutdown, and the operating conditions and shutdown activity recorded. The pump may thereafter be automatically or manually restarted, but shutdown will recur if the condition continues to occur. The deadband range is selected to prevent cavitation that otherwise would occur by incomplete filling of the pump chamber. During cavitation, air or other gases or vapors within the pumping chamber, whether caused by vapor pressure flashes or otherwise, collapse or implode during a high pressure pump stroke, thereby causing premature wear of the pump plungers, valves, or seals. If not corrected, cavitation may cause damage to pump components and possibly catastrophic failure of the power end of the pump. By monitoring instantaneous pump inlet pressure and preventing cavitation conditions, the useful life of the pump may be increased and maintenance costs significantly reduced.

It is important that the instantaneous pump inlet pressure is not detected by a conventional sensor responsive to fluid pressure over a relatively short time period of, for example, 1/10th of a second. Even though the average inlet fluid pressure to the pump is well within the desired operating range, the instantaneous fluid flow to the pumping chamber may be insufficient to prevent cavitation due, for example, to the length of the fluid supply line to the pump. Accordingly, it is important that the instantaneous inlet fluid pressure be monitored to prevent cavitation under conditions wherein the average inlet fluid pressure would suggest that the cavitation should not be occurring.

A serial interface is provided for initial setup of the system operating parameters, and for periodically transferring recorded operating data to another computer for processing and analysis. A modem may be used for interfacing between the system operating computer and the setup/processing computer, thereby allowing both alteration of the operating system and historical output of recorded pump operating parameters at a location remote from the pump and system operating computer.

It is an object of this invention to provide an improved system for monitoring and recording operating conditions of a high pressure plunger pump. It is a related object of the invention to provide an improved monitoring system that will shutdown a pump when the system operating conditions exceed a predetermined range.

The system of the present invention monitors both average and instantaneous inlet fluid pressure to a plunger pump. If the average fluid pressure exceeds an acceptable range that will likely cause pump cavitation, the pump may be shut down. If the instantaneous fluid pressure differential exceeds a deadband, the pump will also be shut down. Accordingly, the monitoring system of the present invention is intended to prevent the operation of a plunger pump under conditions that cause cavitation, thereby extending the useful life of the pump and significantly reducing the maintenance costs for reliably operating a plunger pump.

It is a feature of the invention that the monitoring and shutdown system is substantially tamperproof. Even if the electrical wires interconnecting the controller with the pump motor for startup of the pump are cut, the system may still record pump operating conditions, pump startup and pump shutdown.

It is another feature of the invention that additional sensors may be provided so that additional pump operating parameters may be monitored and recorded, such as pump outlet pressure, inlet fluid temperature, pump rpm, pump housing vibration, and the oil temperature, pressure, and level in the pump power end.

A significant feature of the invention is that pump operation may be periodically reviewed to determine causes of pump failure or high maintenance. The pump monitoring and shutdown system is well suited for use on high pressure plunger pumps that provide pressurized fluid to water blasting and cutting guns.

Yet another feature of this invention is that the monitoring and shutdown system may be easily customized for a particular type of plunger pump. A serial interface may provide communication between a system operating computer and a setup/processing computer. Through use of a modem and cellular phone, pump shutdown control information may be remotely input into the system operating computer, and pump operating data may be output from the system operating computer to the setup/processing computer at a location remote from the pump.

A significant advantage of the present invention is the relatively low cost of providing an effective pump monitoring and shutdown system for a high pressure plunger pump. By having the capability of determining the operating conditions to which the plunger pump is subjected, the warranty life of a plunger pump operating within suggested operating parameters may be extended.

These and further objects, features, and advantages of the present invention will become apparent from the following detailed description, wherein reference is made to the figures in the accompanying drawings.

BRIEF DESCRIPTION OF THE DRAWINGS

FIG. 3 is a flowchart of the reset program loop for the system according to this invention.

FIG. 4 is a flowchart for the real time clock program for the controller according to the present invention.

DETAILED DESCRIPTION OF THE PREFERRED EMBODIMENTS

Figure 1:
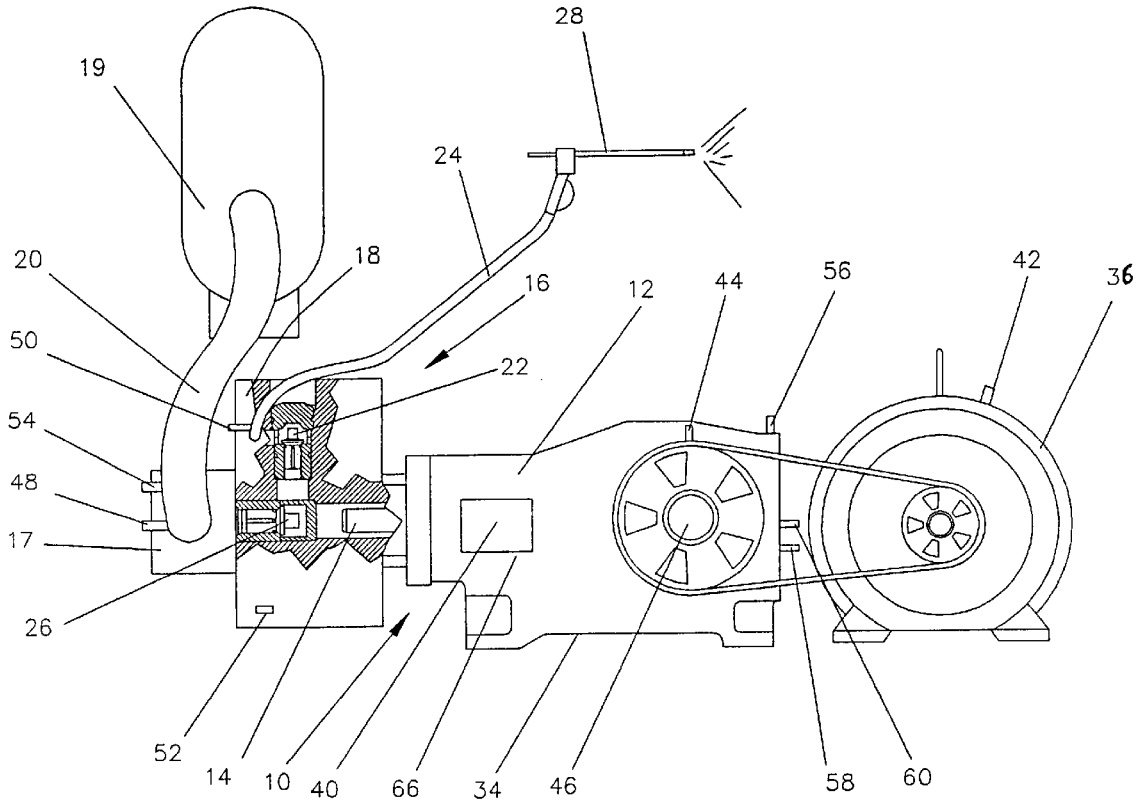
FIG. 1 is a pictorial view of the plunger pump with a suitable pump monitoring and shutdown system in accordance with the present invention.

FIG. 1 discloses a programmable monitoring and shutdown system 10 for controlling operation of a high pressure pump 12 including one or more plungers 14 each movable within the pump fluid end housing 16, which includes a suction manifold 17 and a discharge manifold or cylinder body 18. Each plunger 14 is reciprocated during a pressurizing pump cycle and a return cycle. During the return cycle, fluid from a suitable source 19 flows through the inlet line 20 into suction manifold 17, and is prevented by the outlet check valve 22 from flowing from the pump outlet line 24 back into the end housing 16. During the pressurizing pump stroke, fluid pressurized by movement of the plungers 14 flows out of the end housing 16 and past the pump outlet check valve 22 to the pump outlet line 24. During this pressurizing stroke, fluid flow from the end housing 16 back to the pump inlet 20 is prevented by the fluid inlet check valve 26.

The pump of the present invention is particularly well suited for portable applications, wherein low pressure water from source 19 is transmitted to the fluid inlet of the pump through a flexible flowline 20. High pressure fluid discharged from the pump 12 passes through the flexible lines 24 to a spray gun 28, where an operator manually controls activation of the gun for a spraying or cutting operation. The power end 34 of the pump generates the reciprocating motion to drive the plunger 14 within the fluid end of the pump. The power end in turn is driven by a conventional power source 36, which may have an electrical motor that cyclically reciprocates the plunger 14 at a substantially constant speed, or by a diesel-powered engine that reciprocates the plunger 14 at a varying cyclical speed.

The system 10 according to the present invention comprises a microprocessor-based controller 40 and a plurality of sensors. Controller 40 is preferably mounted directly on the pump 12, and is housed within an encloser or shell with a conventional door. The sensors includes a pump running sensor 42 that is connected to the electrical motor power source 36. An rpm sensor 44 is provided at the pump crankshaft for determining pump startup and the speed at which the pump 12 is operating. Inlet pressure transducer 48 and an outlet pressure transducer 50 are used for monitoring the instantaneous pressure at or closely adjacent the pump inlet 20 and the pump outlet 24, respectively. In an exemplary embodiment, the inlet pressure sensor 48 is immediately upstream from the pump inlet check valve, and the outlet pressure sensor 50 is immediately downstream from the pump discharge check valve. Additional optional sensors include acceleration sensor 52 for monitoring vibration of the pump housing, a fluid inlet temperature sensor 54, an oil temperature sensor 56, an oil pressure sensor 58, and an oil level sensor 60. Each of the oil temperature, pressure, and level sensors measures the respective condition of lubricating oil in the power end of the pump. Each of the transducers or sensors provides a high impedance output to the controller 40 as discussed hereafter, thereby allowing each sensor to effectively be a low-cost, full-bridge sensor.

Figure 2:
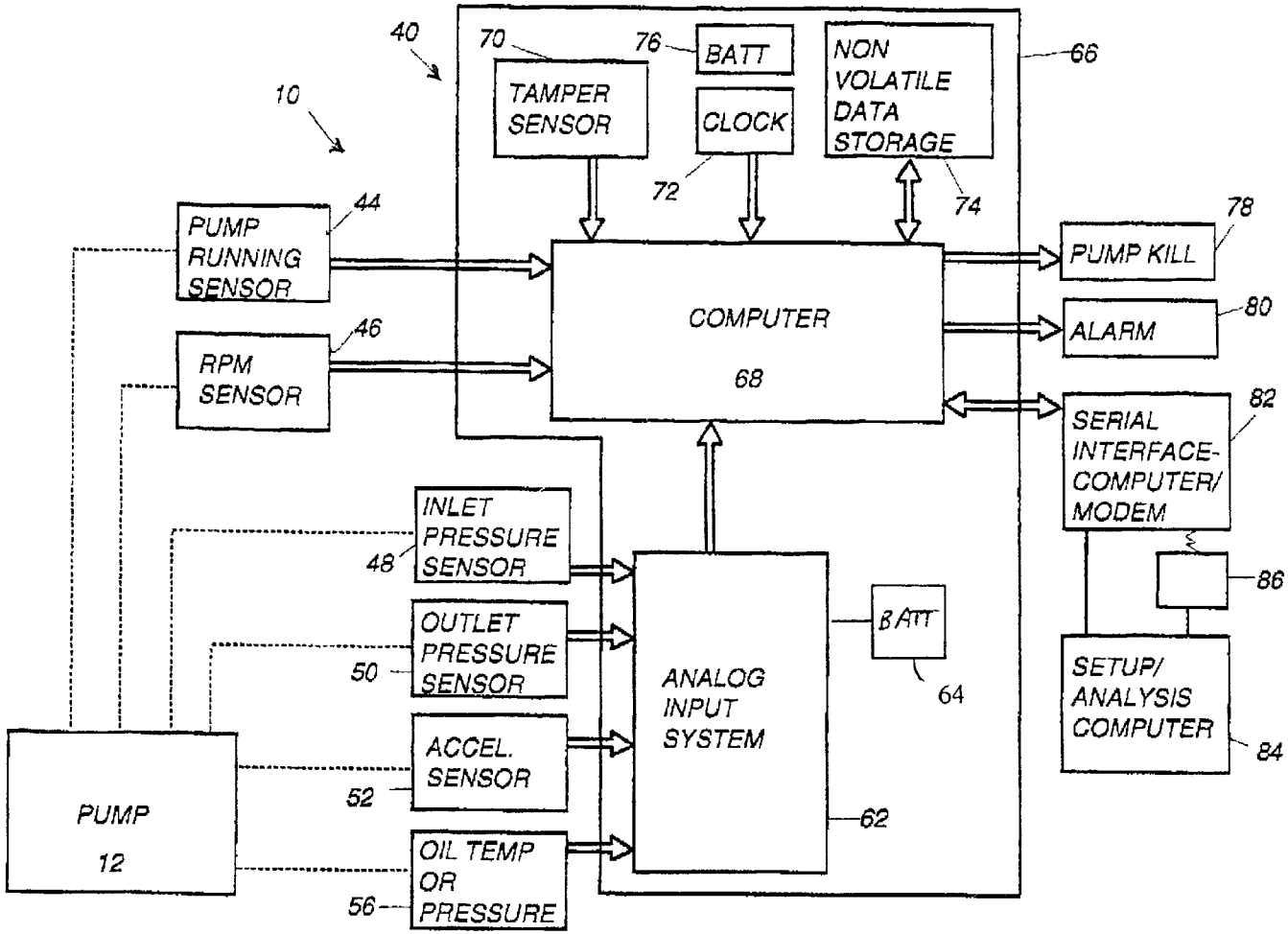
FIG. 2 is a block diagram of the primary components for the system as shown in FIG. 1.

With reference now to FIG. 2, the primary components of the system 10 for monitoring operation of a pump 12 are depicted in block form. The controller 40 is housed within a shell or enclosure 66, which is preferably mounted near the pump. The controller 40 receives electrical signals from a variety of sensors or transducers, such as inlet pressure sensor 48, outlet pressure sensor 50, acceleration sensor 52, and oil temperature sensor 56. The controller 40 may also receive an operating signal from pump running sensor 44 to determine when the pump is running. If the pump is powered by an electric motor having a constant speed, sensor 44 is responsive to operation of the electric motor and allows the controller 40 to determine pump operation and the operating speed of the pump. If the pump is powered by a variable speed power source such as a diesel system, the rpm sensor 44 responsive to rotation of shaft 46 provides an input to the controller 40 to determine pump operation and the pump operating speed.

The controller 40 includes analog input system 62 for receiving the high impedance input from each of the sensors. The analog input system 62 also preferably includes an analog-to-digital converter with an input multiplexer for converting the analog signals to digital signals for processing by the system computer 68. A lithium battery 74 is provided for maintaining the time of day clock and the non-volatile memory, and optionally may be housed within the enclosure 66. The signals from the pump running sensor 44 and the rpm sensor 46 are preferably digital signals for direct input into the system computer 68. If the sensors 44 and 46 provide analog outputs, these signals may be input to the system 62 for conversion to digital signals.

The controller 40 includes a tamper sensor 70 for determining when the door to the enclosure 66 is opened. Once operating parameters of the monitoring system are set by the factory, the pump operator has no need to alter or adjust the system, although system adjustment may be made in the field by authorized manufacturing personnel, as explained hereinafter. Accordingly, it is important for the overall purpose of the monitoring system that a conventional tamper sensor such as a door switch 70 is provided for determining the conditions when the operator is tampering with the controller 40. The controller 40 can be powered at all times for installation that are provided with available AC power. For portable installations that do not include available AC power, such as diesel powered installations, the controller 40 may be placed on stand-by when the pump 12 is not in operating, as determined by one of the sensors 44 and 46.

Processing computer 68 includes a read-only memory, or ROM, which preferably includes a clock 72, and a non-volatile data storage 74, each powered by a lithium battery 76. Battery 64 powers the sensors and the analog input system, and may also supply power to the computer 68 when the sensors 44 and/or 46 indicate that the pump is running. Battery 64 may be recharged by the electrical system that supplies power to an electric motor powering the pump, or by an electrical system powered by a diesel engine that powers the pump. As explained hereinafter, system computer 68 outputs a fault signal, which may activate a shutoff relay or pump kill device 78 for terminating operation of the pump 12. In a suitable embodiment, the shutoff relay or pump kill 78 is a normally open dry relay for terminating operation of the pump 12 in a conventional manner. The fault signal may also activate an alarm 80, which may be either a visual alarm, such as a light, or an audible alarm. The purpose of the alarm is to alert the operator that a fault condition has occurred. Under one embodiment, a light is normally on continuously when the controller 40 is on. The light goes permanently off when an operator has tampered with the system, as detected by the sensor 70. The light blinks or flashes to indicate that a fault signal has been generated. If desired, the sequencing of the blinking light may be used to enable the pump operator to readily determine the condition which caused the generation of the fault signal. For example, the light may flash twice short and once long when the average inlet pressure drops below a preselected value.

The controller 40 also includes a serial interface 82, with an optional computer modem. The serial interface 82 may either be housed within or outside and adjacent the enclosure 66, and allows a setup, processing, and analyzing computer 84 to communicate with the system computer 82. A direct electrical interconnection between the computers 68 and 84 may thus be provided by the serial interface. Alternatively, the interface may include a modem so that a phone 86 may be used to allow two-way communication between the computer 68 and the setup/processing computer 84 while remote from the pump 12.

Shutoff relay or pump kill 78 is thus interconnected to the electrical control circuit of the electric motor or diesel engine that powers the pump 12 and stops the pump when engaged. A signal from the shutoff relay or pump kill switch 78 has no effect on the normal control of the pump by the operator. Computer 68 can be programmed to allow for starting of a pump, either automatically or manually, after a preselected time period has lapsed, such as one second after the pump has been shut off by a fault signal.

Even when the pump 12 is not running, signals from the tamper sensor 70 is input into the process computer 68 and are recorded in the memory of the computer, and the clock 72 runs continuously to record the time of events. It is thus possible to connect a terminal or a modem to the system computer 68 and modify the setup parameters, to download the logged data on the computer 68 to the computer 84, and to display current pump operating parameters on a printout from the setup/processing computer 84.

FIG. 3 illustrates a flowchart of a single reset program loop for the system 10. The controller 40 may be automatically energized in response to a pump running signal from either of the sensors 44 or 46. Once energized, the system computer 68 goes through a reset inquiry of a watchdog timer, or WDT. If the WDT has not been reset, the WDT is reset so that the operation is halted until the WDT reset is generated. The reset program loop as shown in FIG. 3 is thus able to determine if a reset is caused by an initial power-up or a WDT fault condition. On initial power-up, the program thus halts and waits for the WDT to time out for a time period sufficient to ensure that adequate voltage is available to provide reliable operation for the computer 68.

Figure 5A:
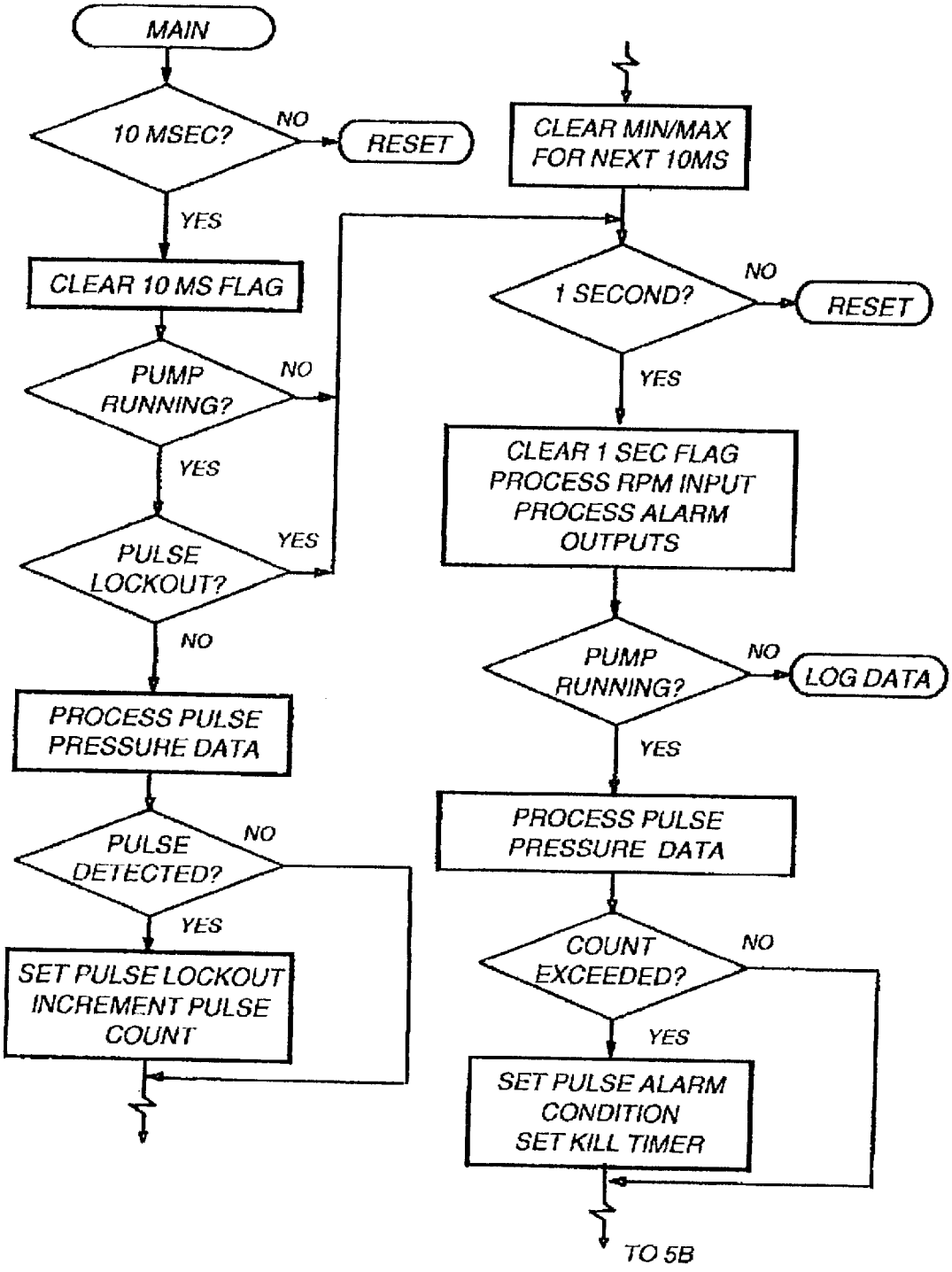
FIGS. 5A and 5B together are a more detailed flowchart of the main operating program used in the system of the present invention.
Figure 5B:
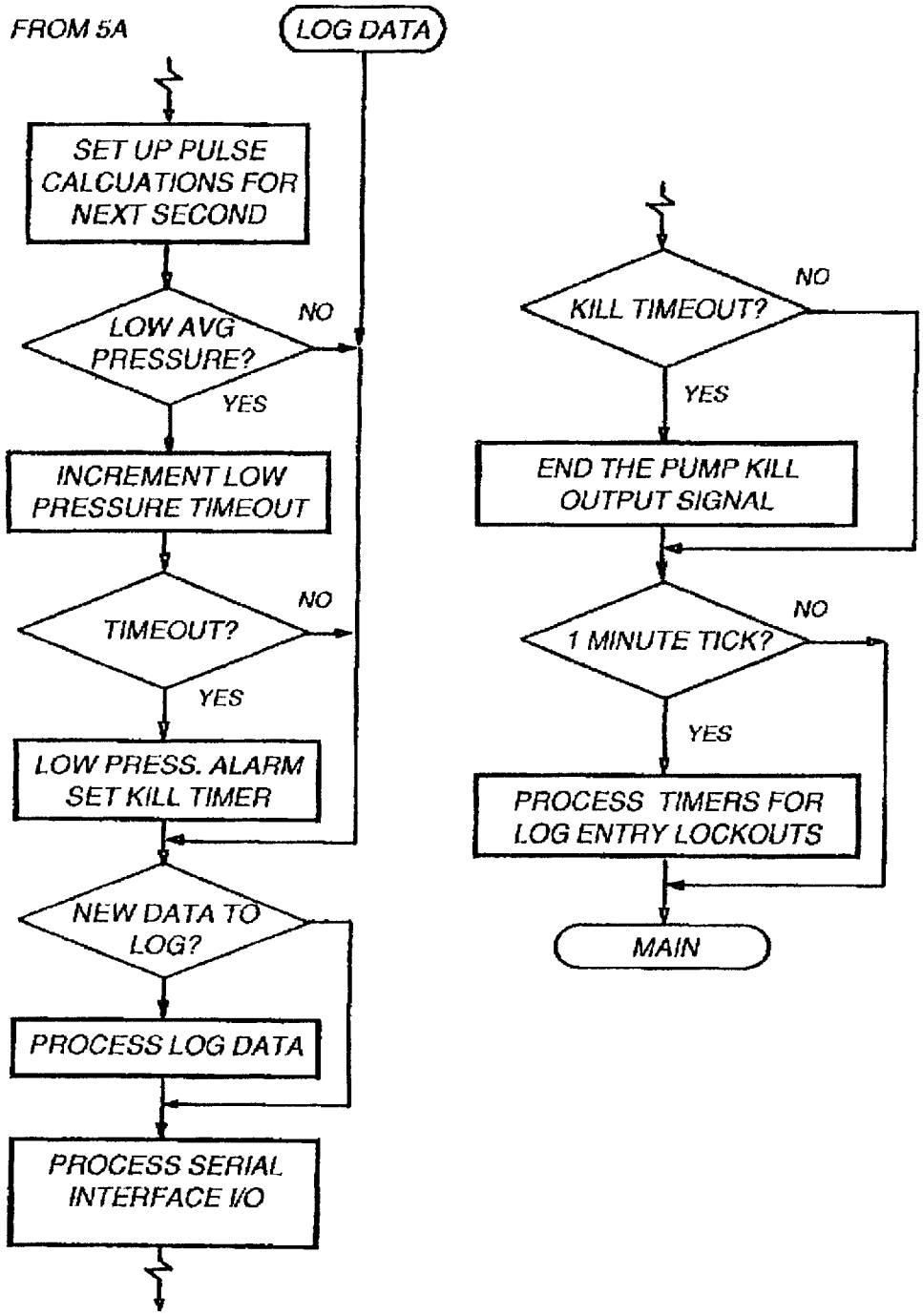

With reference now to FIG. 4, it should be understood that once a WDT reset has occurred, the program loop periodically tests the run status of the pump. The signal from one of those sensors 44 and 46 thus allows the computer 68 to know that the pump is running. An electronic signal indicative of pump operation (for an electric motor powered system) or an rpm signal from sensor 46 (for a diesel powered system), in conjunction with fluid pressure signals, enables the computer to sense pump power information so that the operating horsepower and work output of the pump can be monitored and recorded. When the pump is running, the computer 68 initializes volatile memory and proceeds to the main program, as shown in FIGS. 5A and 5B, which is continually rerun until a signal from one of the sensors 44 and 46 indicates that the pump is no longer running. The time clock interrupt program may also process analog inputs, such as the input from the inlet pressure sensor 48. Accordingly, when the pump running flag is set, indicative of pump operation, the computer 68 reads the analog signals from the sensors; calculates average input pressures, as explained subsequently; and determines maximum and minimum inlet pressure values for each respective 10-millisecond time frame. The computer 68 may also perform other processing of the analog signals from the sensors in order to compare the varying inlet pressure signals to a cavitation signature of inlet pressure signals indicative of cavitation. The real-time clock or RTC program also determines the end of a 10-millisecond time frame, tests for the end of a 1-second time period, and processes digital inputs and outputs. The RTC also initiates inlet pressure signals to be generated every 100 microseconds from the sensor 48, as explained hereinafter. FIG. 5 depicts the detailed flowchart of a suitable system according to this invention for avoiding cavitation in an operating pump. Initially it should be understood that two different techniques may be utilized according to the present invention to determine a cavitation condition: average fluid inlet pressure and instantaneous fluid inlet pressure. Computer 68 determines average inlet pressure during a selected time frame of, for example, 1 second, as established by the RTC. The average pressure is thus calculated based upon each of the instantaneous pressure readings from the inlet pressure sensor 48 during this 1-second time interval, and this calculated average pressure signal is compared to a minimum preselected average pressure value set by the pump manufacturer. If the calculated average pressure drops below a preselected average minimum pressure and stays below the average minimum pressure for a preselected time period, e.g., one second, the computer generates a fault signal to shut down operation of the pump.

Pump operation may also be terminated in response to the instantaneous pressure signals from the inlet pressure sensor 48. Sensor 48 transmits an instantaneous pressure signal to the computer 68 each 100 microseconds in response to the RTC. During a selected time frame of, for example, 10 milliseconds, all the instantaneous pressure signals obtained every 100 microseconds are checked, and the maximum pressure signal and minimum pressure signal detected during this 10 millisecond time frame are determined. If the difference between the lowest minimum instantaneous pressure signal and the highest maximum instantaneous pressure signal exceeds a deadband parameter set by the factory, the pulse count is incremented for the 1-second time frame. Each time the difference between the maximum instantaneous pressure signal and the minimum instantaneous pressure signal during a 10-millisecond time frame is exceeded, another pulse count is generated indicative of an unacceptable sensed magnitude variation in the instantaneous pressure. At the end of the 1-second time frame, the pulse counts may be compared for a predetermined factory program parameter, and if the pulse count exceeds the parameter, e.g., five pulses, a fault signal is generated.

Each time the main program as shown in FIGS. 5A and 5B goes through the loop, it determines whether a new 10-millisecond time frame has occurred. When a new 10-millisecond time frame occurs, the 10-millisecond flag is cleared, and the pump running flag is tested. If the pump is not running, the 1-second flag is tested. If the pump is running, the pulse lockout flag is checked. The pulse lockout flag is set when a pressure pulse is received within the 10-millisecond time frame, thereby locking out the pulse testing for two consecutive time frames and preventing a double count of overlapping pulses. If the pulse lockout flag is not set, the minimum and maximum instantaneous pressures obtained during the 10-millisecond time frame are checked to determine if the differences between these values exceeds the predetermined deadband. If the difference is greater than the predetermined deadband, the pulse lockout flag is set, and the number of cavitation sized or cavitation indicative pulses detected during this 1-second time frame is incremented. After the 10-millisecond time frame, the program is cleared of the minimum and maximum instantaneous pressure signal values in preparation for the subsequent 10-millisecond time frame. In this embodiment, the absolute value of the instantaneous pressure signals is not critical, but rather the difference in the signals during a selected time frame is critical. Between the 10-millisecond time frames, the main loop is idle.

The 1-second flag is tested to determine if it is time for the average signal processing that occurs each one second. If the 1-second flag is not set, the main program is reset or repeated. If the 1-second flag is set, it is cleared and the rpm pulse inputs from sensor 46 or the pump run inputs from sensor 44 are processed along with alarm outputs.

If the pump-running flag is not set, the program moves down to determine if new data is to be logged. If the pump-running flag is set, the pulse count value is compared by the computer to the predetermined minimum average value. If the calculated average value exceeds the predetermined minimum value, the fault signal is generated to terminate operation of the pump. The generated fault signal will be logged in memory, the alarm 80 will be activated, and a lockout timer initiated to prevent multiple log entries of one event.

Referring now to FIG. 5B, pulse calculations are initialized for each 1-second time frame. All fluid inlet pressure signals during that 1-second time frame are thus averaged by the computer to determine an average pressure. If the calculated average fluid inlet pressure falls below the entered predetermined minimum average pressure, the low-pressure timeout counter is incremented. If the timeout reaches the predetermined and entered value, the low pressure alarm is set and the kill timer is set. The program checks to determine if any new information should be saved in the non-volatile memory. Any new alarms are thus recorded and may be subsequently retrieved with the setup/processing computer.

In response to generation of a fault signal, the pump kill or shutoff relay 78 is activated to stop operation of the pump of a selected time period, e.g., one minute. In addition, the alarm 80 is activated to indicate to the operator that a fault signal has been generated. The date, time, fault event type, and all or only selected system operating parameters may be logged in the non-volatile data storage 74 of the controller. A lockout timer is also initiated to ensure that no more fault signals representative of this one fault condition are logged for a specified time period.

Those skilled in the art will appreciate that signals from the sensors 50, 52 or 56 as shown in FIG. 1, or from other system sensors described above, may be intermittently received by the computer and may also be used to shut down operation of the pump. In other words, pump operation may be automatically terminated in response to a low oil level signal from a level sensor or from a high oil temperature signal from the temperature sensor 56. Each type of fault generating signal may be recorded in the computer, and may be later analyzed to determine why pump maintenance is high. Also, the total work output of a pump since its last maintenance may be easily determined to more accurately determine when the next scheduled pump maintenance should occur.

Those skilled in the art will appreciate for that any type of positive displacement pump with a given size plunger and pump rpm, a minimum supply pressure may be determined to prevent cavitation. As suggested by this disclosure, that minimum value will not be simply be a function of the average inlet pressure, but rather will also be a function of the instantaneous fluid inlet pressure. Restrictions in the flow line to the pump, the diameter and length of the flow line to the pump, the inlet fluid temperature, and other factors may thus affect the instantaneous fluid pressure supplied to the pump.

The cost of the monitoring and shutdown system according to the present invention is relatively low in view of the significant benefits obtained by preventing cavitation, particularly since the system has the ability to determine the pump operating conditions at various times. Downloading of the pump operating conditions is particularly important under situations where the conditions of the fluid input to the pump vary considerably, which is often the case when utilizing high pressure blasting or cutting equipment. The system operating parameter can be altered by using the computer 84 to communicate with processing computer 68 through interface 82. Operating data can be easily downloaded at selected times from the memory of computer 68 to computer 84, and then to a suitable display or printout for record maintenance. The computer 84 may include various types of programs for processing and analysis of the data retrieved from system computer 68. By using a modem and telephone, the setup/analysis computer 84 may be located at a site remote from the pump 12 and the controller 40, such as an office of the pump manufacturer or the main office of the service company operating various water blasting crews each with a positive displacement pump.

The system as described herein compares the instantaneous maximum and minimum pressure readings obtained during a preselected time period, such as 10 milliseconds, and determines whether this difference exceeds a preselected deadband range in excess of a certain number of times within a selected time period, such as one minute. Each time the preselected deadband range between the minimum and maximum values is exceeded, a pulse is generated. If the counted pulses exceed a predetermined number within a selected time period, the pump operation is terminated.

According to other embodiments of the invention, the difference between the instantaneous minimum pressure pulse and the instantaneous maximum pressure pulse is not the criteria in determining whether the pump should be shut down. Instead, the number of maximum pressure pulses that exceed a determined maximum value may be compared to the number of minimum pressure pulses that are below a determined minimum value. Each determined maximum and minimum value may be selected based upon a predetermined variation from the average pressure value, or may be a selected standard deviation from a calculated mean value. The ratio of the number of excessive maximum pressure pulses to the number of less than minimum pressure pulses may then be determinative of when the pump will be shut down. According to other embodiments, the time period or duration during which a pulse stays below a determined minimum value is monitored, and this duration indication is used to determine when the pump should be shut down to prevent cavitation.

Still other embodiments of the invention compare the signature of the maximum pulses to the minimum pulses. Nonsymmetrical pulse signatures are considered particularly important for determining when the pump should be shut down. Instantaneous fluid inlet pressure signatures during each 10-millisecond time frame may thus be compared to an acceptable signature, and a fault signal generated when the sensed pressure signature deviates excessively from the acceptable signature, or when the frequency of unacceptable signatures exceeds a selected number within a certain time period. Signals indicative of the instantaneous motor load for driving the pump may be monitored to detect fault conditions. Various other pump vibration sensors, accelerometers, outlet pressure sensors, and motion detectors may be used, preferably in conjunction with inlet fluid pressure sensors, to detect a fault condition. Accordingly, various techniques may be used to generate a fault signal in response to variations in a plurality of instantaneous pressure signals.

Additional modifications and alterations to the embodiments and the methods as described herein should now be apparent to one skilled in the art in view of the foregoing disclosure. Various modifications may thus be made in accordance with the teachings of the present invention, which is not restricted to the embodiments discussed herein and shown in the accompanying drawings. The scope of the invention should thus be understood to include all embodiments within the following claims.

What is claimed is:

1. A system for monitoring the operation of a high pressure pump including one or more plungers each movable within a respective pumping chamber during a pressurizing pump cycle and a return pump cycle, the pump including a fluid inlet for receiving low pressure fluid, a fluid outlet for discharging high pressure fluid, a fluid inlet check valve for preventing fluid flow from the pumping chamber to the fluid inlet during the pressurizing pump stroke, and a fluid outlet check valve for preventing flow from the fluid outlet to the pumping chamber during the return pump stroke, the system comprising:

an inlet fluid pressure sensor for sensing instantaneous fluid pressure upstream from the pumping chamber and generating an electrical signal corresponding to the sensed inlet fluid pressure; and a controller responsive to the inlet fluid pressure sensor for generating a fault signal in response to variations between a plurality of instantaneous pressure signals.

2. The system as defined in claim 1, wherein the controller compares a sensed magnitude variation between a maximum instantaneous pressure signal and a minimum instantaneous pressure signal to a predetermined acceptable instantaneous pressure signal variation that avoids pump cavitation, and the controller generates a count signal when the sensed magnitude variation exceeds the predetermined acceptable instantaneous pressure signal variation.

3. The system as defined in claim 2, wherein the controller generates a fault signal when the number of count signals exceeds a predetermined number within a selected time period.

4. The system as defined in claim 1, further comprising:

a power disconnect responsive to the fault signal for terminating operation of the pump.

5. The system as defined in claim 1, wherein the controller further generates an average inlet pressure signal based on a plurality of instantaneous pressure signals and generates the fault signal when the average inlet pressure signal drops below a preselected minimum average pressure.

6. The system as defined in claim 1, wherein the controller further comprising:

a storage memory for recording the electrical signals corresponding to the sensed instantaneous fluid pressure and to the generation of the fault signal.

7. The system as defined in claim 6, further comprising:

a setup/processing computer; and a serial interface for communication between the storage memory and the setup/processing computer.

8. The system as defined in claim 7, further comprising:

the setup/processing computer being located remote from the pump; and a modem for communications between the storage memory and the remote setup/processing computer.

9. The system as defined in claim 1, further comprising:

a pump operating sensor to determine starting and stopping operation of the pump;

a time clock; and a memory for recording the time of starting and stopping of the pump in response to the pump operating sensor.

10. The system as defined in claim 1, further comprising:

a warning device responsive to the fault signal for indicating the generation of a fault signal.

11. A system for monitoring the operation of a high pressure pump and terminating unacceptable pump operation, the high pressure pump including one or more plungers each movable within a respective pumping chamber during a pressurizing pump cycle and a return pump cycle, the pump including a fluid inlet for receiving low pressure fluid, a fluid outlet for discharging high pressure fluid, a fluid inlet check valve for preventing fluid flow from the pumping chamber to the fluid inlet during the pressurizing pump stroke, and a fluid outlet check valve for preventing flow from the fluid outlet to the pumping chamber during the return pump stroke, the system comprising:

an inlet fluid pressure sensor for sensing instantaneous fluid pressure upstream from the pumping chamber and generating an electrical signal corresponding to the sensed inlet fluid pressure;

a controller responsive to the inlet fluid pressure sensor for generating a fault signal either when a sensed variation in a plurality of instantaneous pressure signals within a selected time period exceeds a predetermined acceptable instantaneous pressure signal variation or when an average inlet pressure signal based on instantaneous pressure signals during a plurality of selected time periods drops below a preselected minimum average pressure; and a power disconnect for terminating operation of the pump in response to the fault signal.

12. The system as defined in claim 11, wherein the controller compares the sensed magnitude variation between a maximum instantaneous pressure signal and a minimum instantaneous pressure signal during the selected time period to the predetermined acceptable instantaneous pressure signal variation, and the controller generates the fault signal in response to the number of sensed magnitude variations exceeding a predetermined acceptable number of variations within a preselected plurality of time periods.

13. The system as defined in claim 11, wherein the controller compares a sensed duration of one or more instantaneous pressure signals within a determined pressure range to an acceptable instantaneous pressure signal duration within the determined pressure range, and the controller generates the fault signal when the sensed duration exceeds the acceptable duration.

14. The system as defined in claim 11, wherein the controller compares a sensed instantaneous pressure signal signature to an acceptable instantaneous pressure signal signature, and the controller generates the fault signal when the sensed signature exceeds an acceptable deviation from the acceptable signature.

15. The system as defined in claim 11, further comprising:

the controller including a storage memory for recording the electrical signals corresponding to the sensed instantaneous fluid pressure and to the generation of the fault signal;

a setup/processing computer; and a serial interface for communication between the storage memory and the setup-processing computer.

16. The system as defined in claim 11, further comprising:

a pump operating sensor to determine starting and stopping operation of the pump;

a time clock; and a memory for recording the time of starting and stopping of the pump in response to the pump operating sensor.

17. A method of monitoring the operation of a high pressure pump including one or more plungers each movable within a respective pumping chamber during a pressurizing pump cycle and a return pump cycle, the pump including a fluid inlet for receiving low pressure fluid, a fluid outlet for discharging high pressure fluid, a fluid inlet check valve for preventing fluid flow from the pumping chamber to the fluid inlet during the pressurizing pump stroke, and a fluid outlet check valve for preventing flow from the fluid outlet to the pumping chamber during the return pump stroke, the method comprising:

sensing instantaneous fluid pressure upstream from the pumping chamber over a time period;

generating electrical signals each corresponding to the sensed inlet fluid pressure;

generating a fault signal in response to variations between a plurality of instantaneous pressure signals; and automatically recording the electrical signals corresponding to the sensed inlet fluid pressure and the generation of the fault signal.

18. The method as defined in claim 17, further comprising:

comparing a sensed magnitude variation between a maximum instantaneous pressure signal and a minimum instantaneous pressure signal to a predetermined acceptable instantaneous pressure signal variation that avoids pump cavitation.

19. The method as defined in claim 17, further comprising:

terminating operation of the pump in response to the fault signal.

20. The method as defined in claim 17, further comprising:

generating an average inlet pressure signal based on a plurality of instantaneous pressure signals; and generating the fault signal when the average inlet pressure signal drops below a preselected minimum average pressure.

21. The method as defined in claim 17, further comprising:

automatically sensing starting and stopping of the pump; and automatically recording starting and stopping of the pump.

22. The method as defined in claim 17, further comprising:

the electrical signals are automatically recorded in a storage memory adjacent the pump; and remotely communicating between the storage memory and a setup/processing computer.

* * * * *